US005391838A

United States Patent [19]

Plummer, III

[11] Patent Number: 5,391,838

[45] Date of Patent: Feb. 21, 1995

[54] FLEXIBLE DOUBLE ELECTRICAL SHIELDING JACKET

[75] Inventor: Walter A. Plummer, III, Santa Ana, Calif.

[73] Assignee: The Zippertubing Co., Los Angeles, Calif.

[21] Appl. No.: 67,569

[22] Filed: May 25, 1993

[51] Int. Cl.[6] ..... H01B 7/34

[52] U.S. Cl. ..... 174/36; 174/105 R; 174/DIG. 11

[58] Field of Search ..... 174/36, DIG. 11, 105 R, 174/107

[56] References Cited

U.S. PATENT DOCUMENTS

| | | | |
|---|---|---|---|
| 2,960,561 | 11/1960 | Plummer, III | 174/36 |
| 3,089,915 | 5/1963 | Plummer | 174/36 |
| 3,106,941 | 10/1963 | Plummer | 174/DIG. 11 |
| 3,254,678 | 6/1966 | Plummer | 174/36 |
| 3,413,406 | 11/1968 | Plummer | 174/36 |
| 3,467,761 | 9/1969 | Plummer | 174/36 |
| 3,582,532 | 6/1971 | Plummer | 174/36 |
| 4,327,246 | 4/1982 | Kincaid | 174/36 |
| 4,409,427 | 10/1983 | Plummer | 174/36 |
| 4,477,693 | 10/1984 | Krabec et al. | 174/36 |
| 4,572,922 | 2/1986 | Plummer | 174/36 |
| 4,691,081 | 9/1987 | Gupta et al. | 174/105 R |
| 4,734,542 | 3/1988 | Klein | 174/36 |
| 5,216,202 | 6/1993 | Yoshida et al. | 174/36 |

*Primary Examiner*—Morris H. Nimmo
*Attorney, Agent, or Firm*—Christie, Parker & Hale

[57] ABSTRACT

An electrical shielding jacket has a first shield formed from a wire mesh strip and a second shield formed from a flexible film bearing a metal coating. The jacket has a flexible casing which is closable by means of a zipper.

16 Claims, 2 Drawing Sheets

FLEXIBLE DOUBLE ELECTRICAL SHIELDING JACKET

BACKGROUND OF THE INVENTION

The invention pertains to a shielded jacket for electrical and electronic cables, and more particularly, to a novel construction of a jacket having two separate shields which may be chosen to optimally shield against different frequencies of electromagnetic radiation.

It is common to use a shielding jacket placed over one or more conductors when either it is necessary to contain electromagnetic emissions from the conductors or to protect the conductors from external electromagnetic emissions. In accordance with Gauss' Law, it is desirable to surround the protected conductors with a grounded conductive surface. As placing a solid metal tube around a conductor would often be highly impractical, the typical shielding jacket uses some form of wire mesh electrical shield which surrounds the conductors. In a closable jacket the shield is generally formed in an elongated, approximately rectangular shape and then wrapped around the conductor to form a tube. Some form of flexible casing similarly surrounds the shield. When such a mesh shield is used, the size and type of mesh are chosen based upon the specific ranges of frequency of the emissions which are to be shielded against. Typically, a mesh does a poor job of shielding against emissions of a wave length substantially smaller than the size of the openings in the mesh.

In a prior shielding jacket manufactured by the applicant, the rectangular shield is formed by flattening a knit wire sleeve. In the prior product a flexible polyvinyl chloride (PVC) casing in the form of a long sheet with a zipper along its edges is provided to surround the shield. A heavy braided wire conductor (braid) is provided for both mechanical reinforcement and to enable a connection to a ground. The shield is disposed flat against the casing. The braid is disposed against the shield running centrally along the shield and is stitched through to the casing using a cloth thread. In operation the shield and casing are wrapped around the conductors which are to be protected. The casing is then zipped up around the shield, and an end of the wire braid may be connected to a ground source such as a connector housing.

For shielding against low-power high-frequency emissions, a light metal foil or metal coated polymer film may be used. The use of a coated film has the advantages that the film provides strength, flexibility and a layer of insulation. The thin metal layer that may be deposited on the film does not, however, perform well in shielding against higher-power lower-frequency emissions.

It is therefore desirable that a flexible, closeable shielding jacket be constructed to offer shielding against a broad frequency range of electromagnetic emissions.

SUMMARY OF THE INVENTION

There is, therefore, provided in practice of this invention according to the presently preferred embodiment, a closable electrical shielding jacket having both a wire mesh electrical shield and a metal coated polymer film shield which offer optimal shielding for different frequencies of electromagnetic radiation. The metal coated surface of the film is placed to face away from the mesh shield so that the mesh shield and the layer of metal coating are electrically insulated from each other by the film. The jacket has a flexible casing which is closable by means of a zipper.

BRIEF DESCRIPTION OF THE DRAWINGS

These and other features and advantages of the present invention will be appreciated as the same becomes understood by reference to the following detailed description when considered in connection with the accompanying drawings wherein.

DETAILED DESCRIPTION

Figure 1:
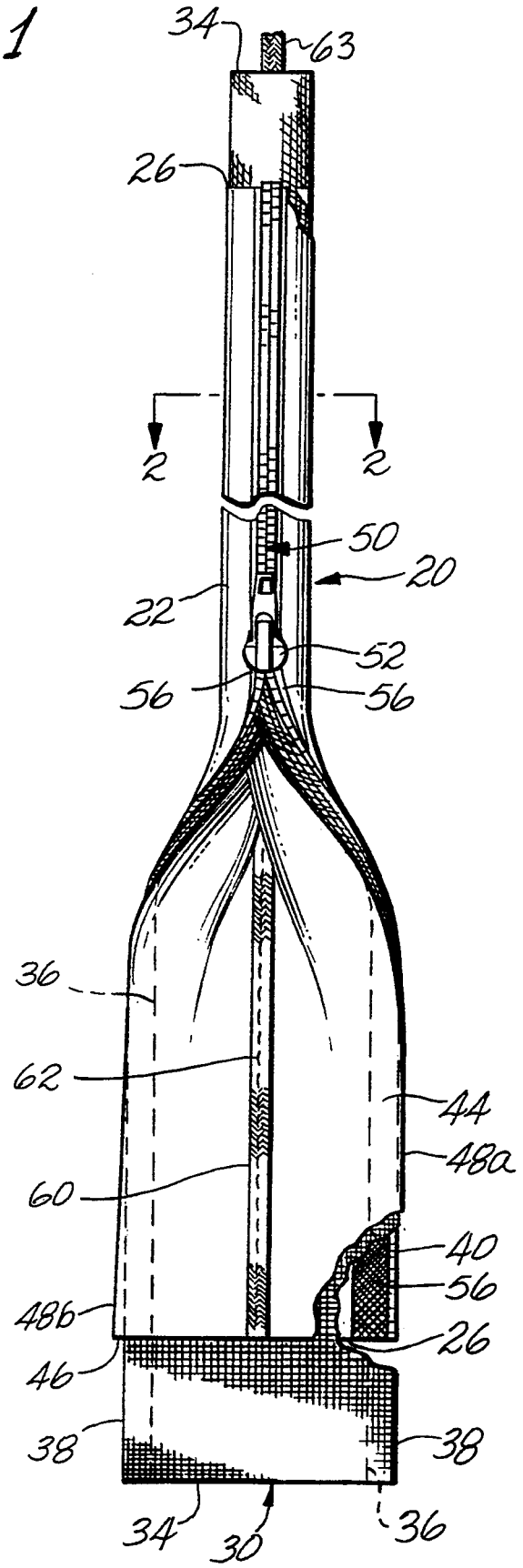
FIG. 1 is a plan view of an electrical shielding jacket according to the preferred embodiment of the present invention, shown partly open and partly closed.
Figure 2:
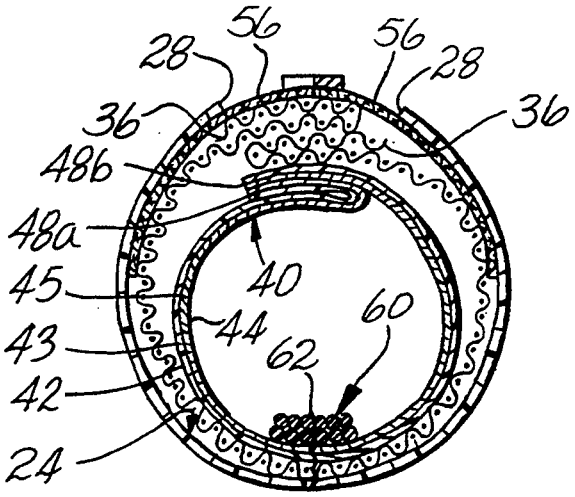
FIG. 2 is a transverse cross-sectional view of a closed portion of the jacket of FIG. 1.

The preferred embodiment of a flexible, closeable electrical shielding jacket constructed according to the principles of this invention, is depicted in FIGS. 1 and 2. To more clearly show the features of the present invention, various elements are shown with exaggerated thickness and the spacings are not drawn to scale.

The jacket has an elongated substantially rectangular casing 20 with inner and outer surfaces 22 and 24 respectively, edges 28 and ends 26. A sheet like outer shield 30 formed from a wire mesh strip is adjacent to the inner surface of the casing. The outer shield ends 34 and edges 38, which edges are formed by folding the strip edges 36 back onto the outer shield. The outer shield ends extend beyond the casing ends to allow for attachment to a connector housing (not shown) for grounding the outer shield.

An inner shield 40 is an elongated and substantially rectangular sheet immediately inside the outer shield. The inner shield has an outer surface 42, formed by a flexible plastic film strip 43, adjacent to the first shield and an inner surface 44, formed by applying a metal layer 45 to the film strip. The inner shield has ends 46 and edges **48*a* and 48*b*. A conventional zipper 50 is provided along the casing edges so that the casing may be closed, to form a tube around any conductors which are to be shielded, and subsequently reopened. The zipper has a slide 52 and tapes 56**, which tapes are attached to a surface of the casing, typically by stitching to the casing.

A heavy wire braided conductor (braid) 60 extends longitudinally along the center of the inner surface of the inner shield and is stitched through to the casing with cloth thread 62. The braid provides increased longitudinal strength and strengthens the shields against being damaged by the thread, as well as allowing a braid extension 63 at an end of the jacket to be connected to a ground to electrically ground the inner shield.

When the casing is closed, a first edge **48*a* of the inner shield is folded back onto its outer surface, as shown in FIG. 2. Thus, the metal layer on the plastic film is on the outside along that edge, so as to provide metal to metal contact when the second edge 48*b* of the inner shield is placed over the first edge to wrap the inner shield. To minimize the possibility of electrical leakage, it is desirable to wrap the outer shield such that its edges are overlapped in an opposite sense from those of the inner shield. As shown in FIG. 2** a right edge of the inner shield overlaps a left edge, whereas a left edge of the outer shield overlaps a right edge. These respective senses of overlap are up to the choice of the person installing the jacket. Naturally, if the jacket is manufactured with an edge of the inner shield already folded, the direction of overlap of the outer shield which provides optimal shielding would be determined.

In the illustrated embodiment the casing is formed from a sheet of flexible polyvinyl chloride (PVC). The outer shield is formed from a strip of square weave 100 mesh (100 strands per inch) copper wire. The flexible film used for the inner shield is polyethylene terephthalate (such as sold under the brand MYLAR). The inner surface of the inner shield has a thin layer of aluminum foil applied to the film. The PVC is chosen for its low cost, flexibility and electrical insulating capability. The copper is chosen for its strength, conductivity and solderability, although suffering from a propensity to corrode. Tin coated copper may be used.

The metal coated surface of the inner shield is placed to face away from the outer shield so that the mesh strip of the outer shield and the metal layer of the inner shield are electrically insulated from each other by the film strip. This prevents the mesh from rubbing the metal off of the strip and facilitates a successive shielding effect.

The strip edges 36 of the outer shield body 32 are folded outward and back onto the body, to lie adjacent the inner surface of the casing, so that the strip edges will not abrade the inner shield, and to minimize unraveling of the mesh.

As shown, the illustrated embodiment provides a continuous inner shield which shields against high frequency electromagnetic emissions. The outer shield is chosen from a metal wire mesh such that it provides shielding against lower frequency emissions than does the inner shield. The mesh is used to form the outer shield as opposed to the inner where the application is such that the mesh shield will be expected to dissipate the most power.

A variety of other materials may be used to fabricate the present invention including aluminum or other wire for a mesh shield and metallized or foil coated polyester or other films for a film strip shield. Forms of an open conductive mesh other than a square weave may be used, such as pierced or expanded sheet metal. Alternatively, knitted, crocheted or braided material may be used. Furthermore, the metal layer of the inner shield may be electrically shorted to the outer shield, such as by a common connection to a ground, depending on the application.

In the illustrated embodiment, the flexible film strip of the inner shield measures 44 millimeters wide, from edge to edge. The outer shield measures 43 millimeters and is formed from a mesh strip 57 millimeters wide. The casing measures 30 millimeters wide, between edges 28, but is augmented to approximately 42 millimeters by the zipper. The dimensions chosen for the jacket are significantly dependent on the application. It is readily apparent that achieve proper shielding each shield must have sufficient width, so that when the casing is closed the edges of the shield will overlap. The jacket may be manufactured in semi-infinite lengths, and then cut for a specific application.

While a preferred embodiment of an closeable electrical shielding jacket has been described and illustrated herein, many other constructions will be apparent to those skilled in the art. It is therefore to be understood that within the scope of the appended claims, the invention may be practiced otherwise than as specifically described.

What is claimed is:

1. A flexible, closeable electrical shielding jacket comprising:

a flexible elongated casing having inner and outer surfaces, two edges and two ends;

an outer elongated electrically conductive shield adjacent the inner surface of the casing and having two edges and two ends;

an inner elongated electrically conductive shield adjacent the first shield and having two edges and two ends; and casing closing means extending along each casing edge for joining the two casing edges for forming a tube;

wherein the inner shield and outer shield optimally shield against different frequency ranges.

2. The electrical shielding jacket of claim 1 wherein the inner and outer shields each have sufficient widths so that their respective edges overlap when the two casing edges are joined.

3. The electrical shielding jacket of claim 1 wherein one of the shields comprises a metal wire mesh strip having two edges and two ends.

4. The electrical shielding jacket of claim 3 wherein the wire mesh strip edges are folded back onto the shield for forming the shield edges.

5. The electrical shielding jacket of claim 4 wherein the folded strip edges are adjacent the inner surface of the casing.

6. The electrical shielding jacket of claim 3 wherein the ends of the wire mesh strip extend beyond the ends of the casing.

7. The electrical shielding jacket of claim 1 wherein one of the shields comprises:

a strip of flexible film having inner and outer surfaces, two edges and two ends; and a layer of metal on one of the surfaces of the film strip.

8. The electrical shielding jacket of claim 1 wherein the outer shield comprises a metal wire mesh strip having two edges and two ends and the inner shield comprises:

a strip of flexible film having inner and outer surfaces, two edges and two ends; and a layer of metal on the surface of the strip of film which is not adjacent to the outer shield.

9. The electrical shielding jacket of claim 7 further comprising a wire braid extending longitudinally along the inner surface of the inner shield and secured through to the casing by stitching.

10. The electrical shielding jacket of claim 8 wherein the mesh strip edges are folded back onto the shield to form the outer shield edges.

11. The electrical shieiding jacket of claim 10 wherein the folded mesh strip edges are adjacent the casing.

12. The electrical shielding jacket of claim 8 wherein the ends of the outer shield extend beyond the ends of the casing.

13. An electrical shielding jacket comprising:

a flexible elongated PVC casing having inner and outer surfaces, two edges and two ends;

an outer elongated electrical shield adjacent the casing and having two edges and two ends, which shield comprises a 100 mesh copper strip having two edges and two ends wherein the strip edges are folded back onto the shield to form the shield edges and are adjacent the inner surface of the casing and the ends of the outer shield extend beyond the ends of the casing;

an inner elongated electrical shield adjacent the outer shield and having two edges and two ends, comprising a strip of flexible polyethylene terephthalate film having inner and outer surfaces, two edges and two ends, and a layer of aluminum on the inner surface of the strip of film, wherein the outer surface of the strip of film is positioned adjacent to the outer shield;

a wire braid extending longitudinally along the layer of aluminum; and a zipper for joining the two casing edges for forming a tube.

14. The electrical shielding jacket of claim 13 wherein an edge of the inner shield is folded back onto the outer surface of the inner shield.

15. The electrical shielding jacket of claim 14 wherein the two casing edges are joined by the zipper to form a tube and wherein the edge of the inner shield which is folded back is overlapped by the other edge of the inner shield and one edge of the outer shield overlaps the other edge of the outer shield in an opposite sense to the edges of the inner shield.

16. A flexible, closeable electrical shielding jacket comprising:

a flexible elongated casing having inner and outer surfaces, two edges and two ends;

an outer elongated electrically conductive shield adjacent the inner surface of the casing and having two edges and two ends;

an inner elongated electrically conductive shield adjacent the first shield and having two edges and two ends; and casing closing means extending along each casing edge for joining the two casing edges for forming a tube;

wherein the inner shield and outer shield are electrically insulated from each other.

* * * * *